US007806819B2

(12) United States Patent
Eigemeier

(10) Patent No.: US 7,806,819 B2
(45) Date of Patent: Oct. 5, 2010

(54) ROTOR FOR LABORATORY CENTRIFUGES WITH HOLD-DOWN ELEMENT FOR CENTRIFUGATION CONTAINERS

(75) Inventor: Frank Eigemeier, Osterode-Dorste (DE)

(73) Assignee: Thermo Electron LED GmbH, Langenselbold (DE)

( * ) Notice: Subject to any disclaimer, the term of this patent is extended or adjusted under 35 U.S.C. 154(b) by 615 days.

(21) Appl. No.: 11/313,627

(22) Filed: Dec. 22, 2005

(65) Prior Publication Data

US 2006/0166802 A1 Jul. 27, 2006

(30) Foreign Application Priority Data

Dec. 23, 2004 (DE) ..... 10 2004 062 232

(51) Int. Cl.
*B04B 5/02* (2006.01)

(52) U.S. Cl. ..... 494/16

(58) Field of Classification Search ..... 494/16, 494/21, 31, 33; 422/72
See application file for complete search history.

(56) References Cited

U.S. PATENT DOCUMENTS

| | | | | | |
|---|---|---|---|---|---|
| 330,779 | A | * | 11/1885 | Frederiksen et al. | 494/16 |
| 3,133,882 | A | * | 5/1964 | Mitchell et al. | 494/16 |
| 3,460,752 | A | | 8/1969 | Lucas | |
| 3,901,434 | A | * | 8/1975 | Wright | 494/16 |
| 4,114,803 | A | * | 9/1978 | Romanauskas | 494/16 |
| 4,290,550 | A | * | 9/1981 | Chulay et al. | 494/43 |
| 4,301,963 | A | | 11/1981 | Nielsen | |
| 4,449,965 | A | * | 5/1984 | Strain | 494/16 |
| 4,553,955 | A | * | 11/1985 | Lam et al. | 494/16 |
| 4,690,670 | A | * | 9/1987 | Nielsen | 494/16 |
| 4,801,290 | A | * | 1/1989 | Gunter | 494/16 |
| 4,820,257 | A | * | 4/1989 | Ishimaru | 494/16 |
| 4,832,679 | A | * | 5/1989 | Bader | 494/16 |
| 4,944,721 | A | * | 7/1990 | Carson | 494/16 |
| 5,127,895 | A | * | 7/1992 | Pawlovich | 494/16 |
| 5,232,432 | A | * | 8/1993 | Eberle | 494/16 |
| 5,354,254 | A | * | 10/1994 | Zabriskie et al. | 494/12 |
| 5,380,435 | A | | 1/1995 | Stokes et al. | |
| 5,411,465 | A | * | 5/1995 | Glen et al. | 494/16 |
| 5,558,616 | A | * | 9/1996 | Barkus et al. | 494/12 |

(Continued)

FOREIGN PATENT DOCUMENTS

DE 2316015 3/1974

(Continued)

OTHER PUBLICATIONS

UK Intellectual Property Office, Patents Act 1977 Examination Report Under Section 18(3), Date of Report Dec. 13, 2007 (2 pages).

*Primary Examiner*—Charles E Cooley
(74) *Attorney, Agent, or Firm*—Wood, Herron & Evans, LLP

(57) ABSTRACT

The invention relates to a rotor for laboratory centrifuges which is designed for accommodating at least one centrifugation container, and an adapter for accommodating a sample vessel and for use in a laboratory centrifuge rotor. The rotor has at least one hold-down element by which the at least one centrifugation container is held in the rotor and protected from axial displacement. In addition, a contact pressure may be produced on the at least one centrifugation container on the rotor.

23 Claims, 8 Drawing Sheets

U.S. PATENT DOCUMENTS

| | | | | |
|---|---|---|---|---|
| 5,562,583 | A * | 10/1996 | Christensen | 494/16 |
| 7,371,206 | B2 * | 5/2008 | Eigemeier et al. | 494/16 |
| 2006/0166802 | A1 * | 7/2006 | Eigemeier | 494/16 |
| 2006/0183620 | A1 * | 8/2006 | Eigemeier et al. | 494/16 |

FOREIGN PATENT DOCUMENTS

| | | | |
|---|---|---|---|
| DE | 2264901 | A1 | 10/1975 |
| DE | 3639041 | A1 | 5/1987 |
| JP | 62061661 | A * | 3/1987 |
| JP | 04083544 | A * | 3/1992 |
| SU | 1329830 | A1 | 8/1987 |
| WO | 90/05590 | A1 | 5/1990 |

* cited by examiner

ROTOR FOR LABORATORY CENTRIFUGES WITH HOLD-DOWN ELEMENT FOR CENTRIFUGATION CONTAINERS

CROSS REFERENCE TO RELATED APPLICATIONS

This application claims priority to German Patent Application Serial No. 102004062232.9, filed Dec. 23, 2004 entitled, ROTOR FOR LABORATORY CENTRIFUGES, the disclosure of which is incorporated by reference in its entirety.

FIELD OF THE INVENTION

The invention relates to a rotor for laboratory centrifuges which is designed for accommodating at least one centrifugation container, and an adapter for accommodating a sample vessel and for use in a laboratory centrifuge rotor.

BACKGROUND OF THE INVENTION

In the present context, a centrifugation container on the one hand may be a sample vessel in which the samples to be centrifuged are placed. On the other hand, a centrifugation container may also be an adapter which may be inserted into a rotor and in which, in turn, a sample vessel may be placed.

The invention preferably relates to a fixed-angle rotor having a circumferential annular trough, situated concentrically about the rotor axis, which is designed as an annular groove. The annular trough is designed for accommodating the centrifugation containers. The centrifugation containers are positioned at a distance from one another in the circumferential direction in the annular trough, and are inclined inwardly at a predetermined angle with respect to the rotor axis, the upper end in each case being closest to the center of the rotor. The upper end includes the opening of the centrifugation container, and in each case is positioned facing the rotor opening.

The rotors known from the prior art are generally designed so that the centrifugation containers may be pushed into the rotor, along their longitudinal direction, through an opening in the upper region of the rotor. During the loading or unloading process or also during operation, the centrifugation containers may be accidentally moved from the operating position. In particular when sample vessels are removed, the adapter in which the sample vessel is situated may inadvertently be removed from the rotor along with the sample vessel. In addition, unintentional removal of centrifugation containers from the annular trough or contact, with play, of the centrifugation containers in the annular trough may cause the centrifuge to run unevenly.

SUMMARY OF THE INVENTION

The object of the present invention is to provide a rotor for laboratory centrifuges and an adapter for such centrifuges by which the handling and stability of the centrifuges and the running characteristics thereof are improved.

This object is achieved for the rotor by the fact that at least one hold-down element is present by which the at least one centrifugation container is held in the rotor and protected from axial displacement. The presence of a hold-down element according to the invention fixes the centrifugation container in the axial direction and thereby protects it from unintentional or unauthorized removal. In addition, to protect strictly from axial displacement it is preferred to use the hold-down element to produce a contact pressure on the at least one centrifugation container held down on the rotor. To this end, a force acting in the longitudinal axial direction is applied to the at least one centrifugation container via the at least one hold-down element. The production of a contact pressure is particularly preferred when multiple centrifugation containers are present distributed over the circumference of the annular trough. If the centrifugation containers are distributed essentially uniformly, the annular trough is braced in a manner similar to a spoked wheel, and ovalization of the centrifuge during the centrifugation process, caused for example by uneven loading, is avoided. The application of a longitudinal axial force to the centrifugation containers by the at least one hold-down element intensifies this spoke effect and further improves the bracing of the centrifuge. At the same time, the bearing stability of the at least one centrifugation container in the rotor is further improved. The presence of a contact pressure results in stabilization of the rotor body with respect to stress from centrifugal forces.

It is also advantageous that the hold-down element holds the centrifugation container in the axial direction in a play-free manner in the rotor, thereby providing stable bearing of the centrifugation containers in the rotor. Unintentional removal of the centrifugation containers is thus prevented, thereby improving the handling. Furthermore, the risk of damage to the sample vessels during unintentional removal is thus eliminated. Compared to the prior art, less attention is required by the user in operating the centrifuge.

The hold-down element is advantageously designed to simultaneously hold multiple centrifugation containers in the rotor. This has the advantage that the manufacture and operation are simplified. In principle, the hold-down element may be designed to secure any given number of centrifugation containers, thereby preventing axial displacement of all centrifugation containers situated in the rotor. On the other hand, multiple hold-down elements may also be present in the rotor. Depending on the configuration and design of the rotor and the centrifugation containers, the number of hold-down elements may be selected so that the material requirements and manufacturing costs are optimized. It is also possible to provide a multipart design for a hold-down element. This is advantageous, for example, when for certain rotor geometries it is difficult to install a hold-down element with a one-piece design, and it is simpler to install individual hold-down segments.

In one embodiment of the invention, the hold-down element is detachably fastened to the rotor. In the fastened state the hold-down element protects the centrifugation containers from axial displacement. The hold-down element must be detached from the rotor beforehand in order to remove the centrifugation container from the rotor. Conversely, the centrifugation containers are to be used before the hold-down element is installed in the rotor. If the centrifugation container is designed as an adapter, it is advantageous to design the hold-down element so that in the installed state the latter holds only the adapter in the rotor, thus enabling the sample vessels to be inserted into and removed from the adapter. In the installed state the hold-down element is advantageously connected to the centrifugation container with a positive fit.

In principle, the hold-down element may be fastened to the rotor using any fastening means known from the prior art (such as screws, bolts, clamps, etc.). It is preferable to provide the hold-down element with a screw thread, and to provide a corresponding counter-thread on the rotor, so that the hold-down element can be screwed into the rotor. This is advantageous in that no additional fastening means is necessary for attaching the hold-down element to the rotor, yet the hold-down element may be easily detached from the rotor.

To allow the centrifugation containers to be inserted into and removed from the rotor and simultaneously ensure that the centrifugation containers are held in the rotor without having to install or remove the hold-down element, it is advantageous to design the hold-down element so that it can be positioned between a holding position and a release position, i.e., brought into a holding state and a release state. This allows centrifugation containers to be exchanged more quickly and easily, thereby increasing the user-friendliness of the rotor. The hold-down element is preferably placed in the holding position at least during the centrifugation process. This ensures that the centrifugation containers are securely mounted in the rotor during the centrifugation process and therefore not damaged. Conversely, the hold-down element is brought into the release position to insert centrifugation containers into, or remove them from, the rotor.

In a further embodiment it is preferred that the hold-down element is connected to the centrifugation container by a positive fit. The positive fit ensures stable and secure contact of the hold-down element with the centrifugation container, thereby improving the general protection of the centrifugation container in the rotor.

To produce a positive fit in the simplest possible manner while simultaneously ensuring a secure bearing, the hold-down element is designed to act as a lock on the centrifugation container. The hold-down element exerts this locking function on the centrifugation container in the holding position. Either parts of the hold-down element or the hold-down element as a whole may act as a locking element. In the first variant, it is advantageous to design only the parts of the hold-down element which are provided as locking elements to be positionable between the holding position and the release position. In contrast, in the second variant the entire hold-down element is designed to be movable between the two positions.

In one refinement of the invention, the locking element is designed as a rotary or swivel lock. The locking element has a point of rotation, i.e., a rotational axis, about which the locking element may be moved back and forth between the holding position and the release position by swiveling or rotating. In principle, the rotational or swivel plane of the locking element may be situated in any position, i.e., horizontally, vertically, or diagonally, with respect to the rotor axis. It is advantageous to provide a stop for both the holding position and the release position to allow precise positioning of the locking element.

Alternatively, it is preferred to design the locking element to be displaceable between the two positions. In principle, the motion may occur along any given axis, thus allowing the locking element to be optimally adapted to the particular geometry of the rotor in which it is used. It is particularly preferable for the displacement to be essentially perpendicular to the rotor axis. Similarly as for the swiveling of the locking element, it is advantageous to provide stops for the two positions for the displacement as well. A combined motion composed of swiveling/rotation and displacement or any other motion is also possible in principle.

In principle, the hold-down element may be designed to be manually actuatable by the user. The hold-down element preferably can be positioned between the two positions without manual actuation. For this purpose, it is advantageous to design the hold-down element to be self-locking. In other words, the hold-down element can be moved into the holding position without a manual or other mechanical actuator, thereby locking the centrifugation container. The self-locking is usually initiated as a result of a change in an external influencing factor, for example, the influence of centrifugal force, increased air pressure, etc. It should be possible to maintain the self-locking at least during the centrifugation process. In this regard it is advantageous, as previously mentioned, that no actuator is necessary for moving the hold-down element, thereby further improving the design and handling of the rotor.

Furthermore, as an alternative it is preferable for the hold-down element to have a drive by which the hold-down element is moved between the release position and the holding position. In this regard it is advantageous for a secure and automated positioning of the hold-down element to be enabled. The drive preferably is either pneumatic, driven by spring force, or designed as an electromotor. In principle, any other types of drives known from the prior art may also be used.

If the hold-down element is provided with a drive, a control device is also advantageously present which is able to control the hold-down element and thereby specify the positioning thereof. The control device may be designed as an autonomous system, so that the positioning is carried out based on the predetermined parameters, or the system may be coupled to other systems such as the rotor drive. The controllability of the hold-down element further simplifies the handling of the rotor and increases the level of automation.

The hold-down element is advantageously positioned depending on the operating state of the rotor (for example, the magnitude of the centrifugal force, the magnitude of the rotational speed, state of the rotor drive, etc.). The dependence of the positioning of the hold-down element on one or more of these parameters has the advantage that the hold-down element is always in the optimal position, depending on the operating state of the rotor. Basically, any other parameter on which the operating state of the rotor depends may also be used as a variable for positioning the hold-down element.

As an alternative to the positive-fit connection of the hold-down element to the centrifugation container, it is preferable to connect the hold-down element to the centrifugation container by a friction fit. As a result of the friction fit, in addition to the protection strictly from displacement in the axial direction a contact pressure is applied by the hold-down element to the rotor body, thereby further improving the secure bearing of the centrifugation container in the rotor and the bracing of the rotor trough acted on by centrifugal forces. If the hold-down element is positionable between a release position and a holding position, it is advantageous to produce the friction fit in the holding position.

The positive fit is preferably produced by the wedge effect of the hold-down element on the centrifugation container. In this regard it is advantageous to design the holding position without a stop, so that the hold-down element is moved in the direction of the holding position until the greatest possible degree of wedging, and therefore the greatest possible contact pressure, is achieved. Alternatively, it is preferable for the friction fit to be provided as frictional engagement. In this regard it is advantageous that the hold-down element makes lateral contact with the centrifugation container, and applies a frictional force thereto which is great enough to protect the centrifugation container from displacement in the axial direction. Planar contact by the hold-down element on the side wall of the centrifugation container increases the friction effect.

As an alternative, it is also preferable to produce the friction fit by elastic force. At least one spring element is advantageously situated between the rotor and the particular centrifugation container. The spring element exerts a retention force on the centrifugation container. The spring element may engage with the centrifugation container laterally, axially, or from another direction.

The spring element preferably is designed as a catch lock composed of a catch element and a counterpart, one being provided on the hold-down element and the other on the centrifugation container. The catch element is able to engage with the counterpart by overcoming an elastic force.

Alternatively, it is preferable for the spring element to be designed as a rubber element, which preferably is situated between the rotor body and the centrifugation container. The rubber element may be designed as a bead, circumferential lip, or nib. In the embodiment as a circumferential lip, the rubber element is preferably designed as an O-ring situated on the rotor hub, concentric to the rotor axis. Multiple rubber elements may also hold one centrifugation container in the rotor. Inserting the centrifugation container into the rotor compresses the rubber element, thereby producing a contact pressure on the centrifugation container. At the same time a friction force acts on the centrifugation container. Alternatively, the rubber element may also be situated directly above the centrifugation container in the inserted state. In this embodiment, the rubber element is compressed when the centrifugation container is inserted, and expands back after the centrifugation container is fully inserted. The rubber element thus contacts the upper edge of the centrifugation container and offers resistance to axial displacement, which can be overcome only by application of considerable force. An advantage in the embodiment of the spring element as a rubber element is the simple and economical manufacture.

In a further preferred embodiment, in the holding position the hold-down element contacts the end face of the upper end of the at least one centrifugation container. If multiple centrifugation containers are present, the hold-down element advantageously contacts the end face of the individual centrifugation containers. Contact of the hold-down element with the end face of the centrifugation container minimizes the force required to protect against displacement of the centrifugation containers in the axial direction. The end face of the centrifugation container preferably has a flat design, and the hold-down element rests flush against the end face. A flat bearing surface is thus produced which transmits force better than a point-specific bearing. If the centrifugation container is designed as an adapter, the hold-down element advantageously contacts the adapter at the edge region of its end face, so that the adapter opening in which a sample vessel is introduced is not blocked.

Alternatively, it is preferred that the hold-down element contacts a side wall of the centrifugation container. It is possible in principle for the hold-down element to contact multiple side walls of a centrifugation container, or to make circumferential contact. This embodiment is particularly preferred for use for hold-down elements that are connected to the centrifugation container by frictional engagement.

Furthermore, as an alternative it is preferable to provide in the side wall of the centrifugation container a shoulder in which the hold-down element engages. In this regard it is advantageous for the hold-down element to act exactly opposite to the direction of axial displacement by contact with the shoulder, so that the application of force for holding the centrifugation container in the rotor is relatively low. The shoulder may also be designed as a counterpart for a locking connection.

In a further preferred embodiment, the hold-down element is designed as an annular disk concentrically situated with respect to the rotor. For accommodating a motor shaft, laboratory centrifuge rotors have a hub, situated approximately centrally, around which the annular disk is advantageously provided. The annular disk may be detachably fastened to the rotor, or may also be movable between the holding position and the release position. In the latter variant, the annular disk advantageously is designed as a rotating ring which in the installed state, i.e., in the holding position, contacts the end face of the centrifugation containers. The annular disk is preferably designed in such a way that it protects all centrifugation containers present in the rotor from axial displacement. In this regard, it is advantageous for the annular disk to represent an easily constructed embodiment of the hold-down element which is simple to manufacture. Furthermore, only one annular disk is necessary to hold all centrifugation containers in the rotor. The annular disk is advantageously designed so that it contacts the inner edge region, as observed from the rotor axis. In principle, however, contact at the center or the outer edge region of the centrifugation containers is also possible.

In a further embodiment, the hold-down element is designed to protect the centrifugation container not only from axial displacement, but also from displacement in the circumferential direction of the centrifuge. This has the advantage that it is not necessary to provide additional elements on the rotor as protection from displacement of the centrifugation containers in the circumferential direction, thereby simplifying manufacture of the rotor.

The centrifugation containers advantageously have a conical design, with the centrifugation containers tapering toward the base. If the hold-down element exerts a force on the centrifugation containers in the axial direction, in this embodiment it is advantageous for a wedge effect to be produced between the centrifugation container and the rotor wall as the result of the conical design. This wedge effect acts as an additional retention force on the centrifugation containers, thereby further improving the bearing.

In a further preferred embodiment, the at least one hold-down element is integrated into the rotor cap. This reduces the number of individual rotor parts and makes installation of the hold-down element unnecessary, thus further improving the handling. In this embodiment the hold-down element may be designed, for example, as a circumferential bead or ridge which is located on the underside of the cap and which in the closed state contacts the end face of the centrifugation containers. Also possible is a design with individual projections, each of which holds down one centrifugation container. If the cap is attached to the rotor approximately at the center of a screw cap, tension may be applied to the centrifugation containers by tightening the screw connection over the hold-down element, thereby improving the spoke effect of the centrifugation containers.

As previously described, the spoke effect of the adapters may be further improved by applying a longitudinal force by means of the at least one hold-down element. In addition to this indirect improvement in stability of the annular trough, it is preferred that the at least one hold-down element directly improves the stability of the annular trough by designing the hold-down element as bracing for the annular trough. This may be achieved, for example, by providing the hold-down element in the radial direction between the outer and inner walls of the annular trough, for example in the region between the individual centrifugation containers. The hold-down element thus acts as a pressure support, and reduces the ovalization effects which occur with partial load on the rotor.

The object of the invention is further achieved by use of an adapter for accommodating a sample vessel and for use in a laboratory centrifuge rotor, having at least one hold-down element by which the adapter is held in the rotor and protected from axial displacement.

In one preferred embodiment, multiple hold-down elements are provided on one adapter, and cooperate to hold the adapter in the rotor. In this regard, it is advantageous that in this manner large forces may be absorbed, thereby ensuring a secure bearing of the adapter in the rotor.

The hold-down element is advantageously designed as a catch element which engages with a counterpart located in the rotor. The locking connection is designed to be detachable, and thus ensures easy insertion and removal of the adapter into and out of the rotor.

Alternatively, it is advantageous to design the hold-down element as a spring element. The spring element is situated between the adapter and the rotor, so that the elastic force acts on the rotor and thereby holds the adapter in the rotor. The spring element advantageously comprises a rubber element, which preferably is designed as a circumferential rubber ring around the adapter. In principle, the rubber element may also be designed as a bead, nib, or other forms known from the prior art. The rubber element is thus sized in such a way that its projection beyond the adapter is larger than the distance between the adapter and the rotor, so that in the inserted state of the adapter the rubber element is compressed in the rotor, thereby producing a retention force. In this manner the hold-down element may be easily and economically manufactured.

BRIEF DESCRIPTION OF THE DRAWINGS

The invention is further described below, with reference to the exemplary embodiments illustrated in the drawings. These examples are intended for illustration only, however, and the invention is not limited thereto. The drawings show the following in schematic form.

DETAILED DESCRIPTION

In the various embodiments of the present invention illustrated in the figures, identical components are provided with the same reference numbers.

Figure 1:
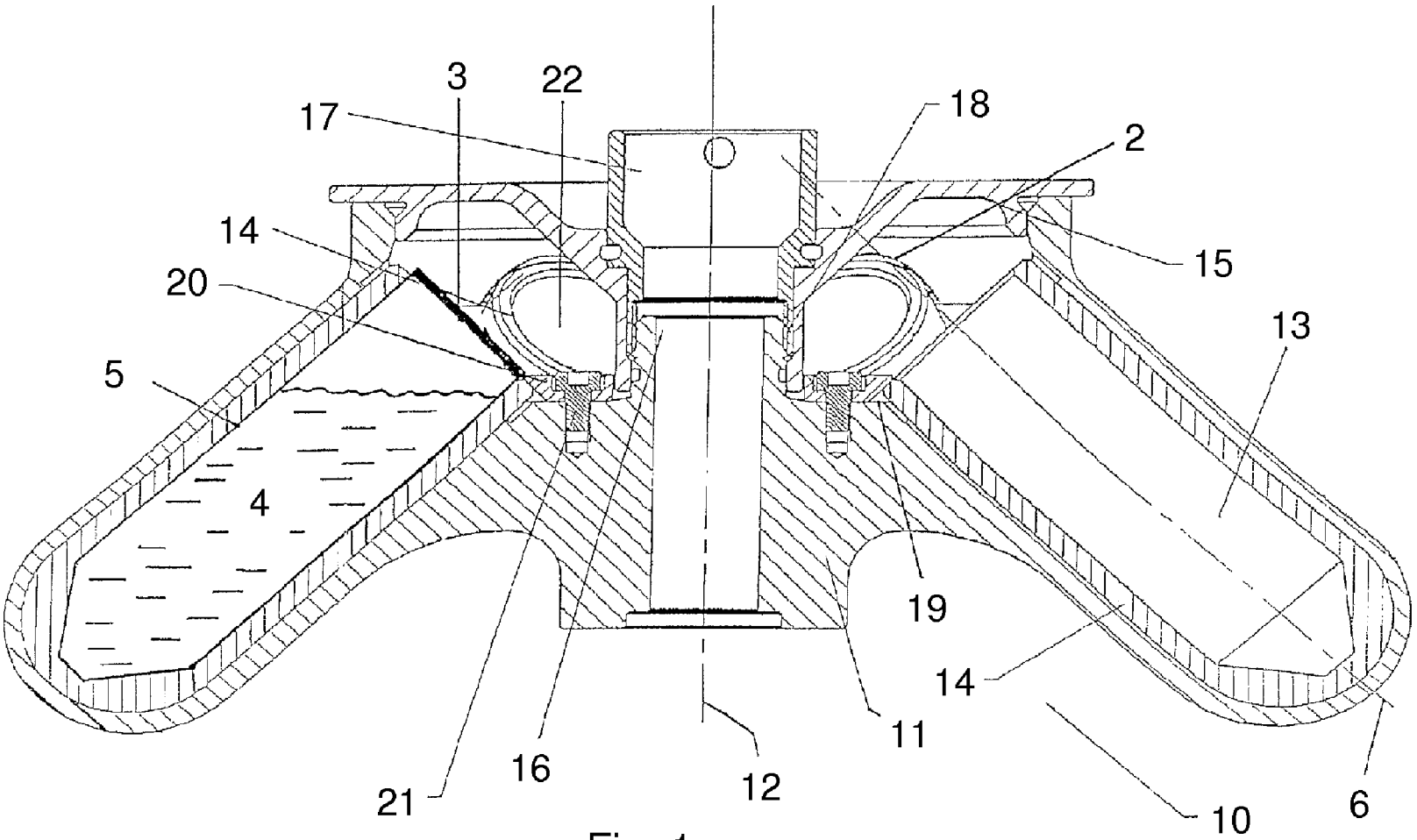
FIG. 1 shows a sectional side view of a rotor having a hold-down element designed as an annular disk.

FIG. 1 shows a cross section of a rotor 10 for laboratory centrifuges. The rotor 10 has the shape of a truncated cone, having an upwardly tapering rotor body 11. An annular trough 13, situated concentrically around the rotor axis 12, is also provided in the outer region of the rotor 10. Inside the annular trough 13, adapters 14 are situated at regular intervals in the circumferential direction which are designed for accommodating sample vessels 5. The sample vessels 5 have a lid 3 at their upper ends, and are filed with sample liquid 4.

The adapters 14 are designed essentially as hollow cylinders which are closed at the bottom and open at their upper end face. Arch-shaped recesses 2 are provided in the outer wall of the annular trough which are designed to respectively accommodate one adapter 14 with a positive fit and to secure the adapters 14 in the circumferential direction. The adapters 14 are thus displaceable essentially only along their longitudinal axis 6. FIG. 1 also shows that the rotor 10 has a rotor cap 15 which is fastened by a cap fastening screw 17, which is screwed into the rotor hub 16 by means of a screw thread 18.

The region of the surface of the rotor body 11 between the annular trough 13 and the rotor hub 16 is designed as a flat bearing plate 19 aligned perpendicularly to the rotor axis 12. A hold-down element designed as an annular disk 20 rests on this bearing plate 19. The annular disk 20 is fastened to the rotor body 11 by screws 21. The outer edge of the annular disk 20 is inwardly beveled from top to bottom, so that the face of the beveled edge is aligned approximately perpendicularly to the adapter axis 6. The annular disk with its beveled edge is essentially flush with the inner edge of the adapter 14. The annular disk 20 terminates at the edge of the adapter 14, so that the opening 22 in the adapter 14 is not blocked and the sample vessels 5 may be inserted into and removed from the adapter unhindered. When the annular disk 20 is installed, a force is applied to the adapter 14 by tightening the screws 21. This force produces a contact pressure between the base of the adapter 14 and the rotor body 11. The adapters 14 thus act as spokes for the annular trough 13, and brace it. Ovalization of the rotor body, resulting from an unevenly distributed load during the centrifugation process, for example, is avoided by a uniform distribution of the adapters in the circumferential direction. In order for the force to be transmitted to the edge of the adapter at an angle to the adapter axis 6, the force has a lateral component. This lateral force exerts a wedge effect on the adapter 14, thereby additionally stabilizing the bearing of the adapter.

Figure 2:
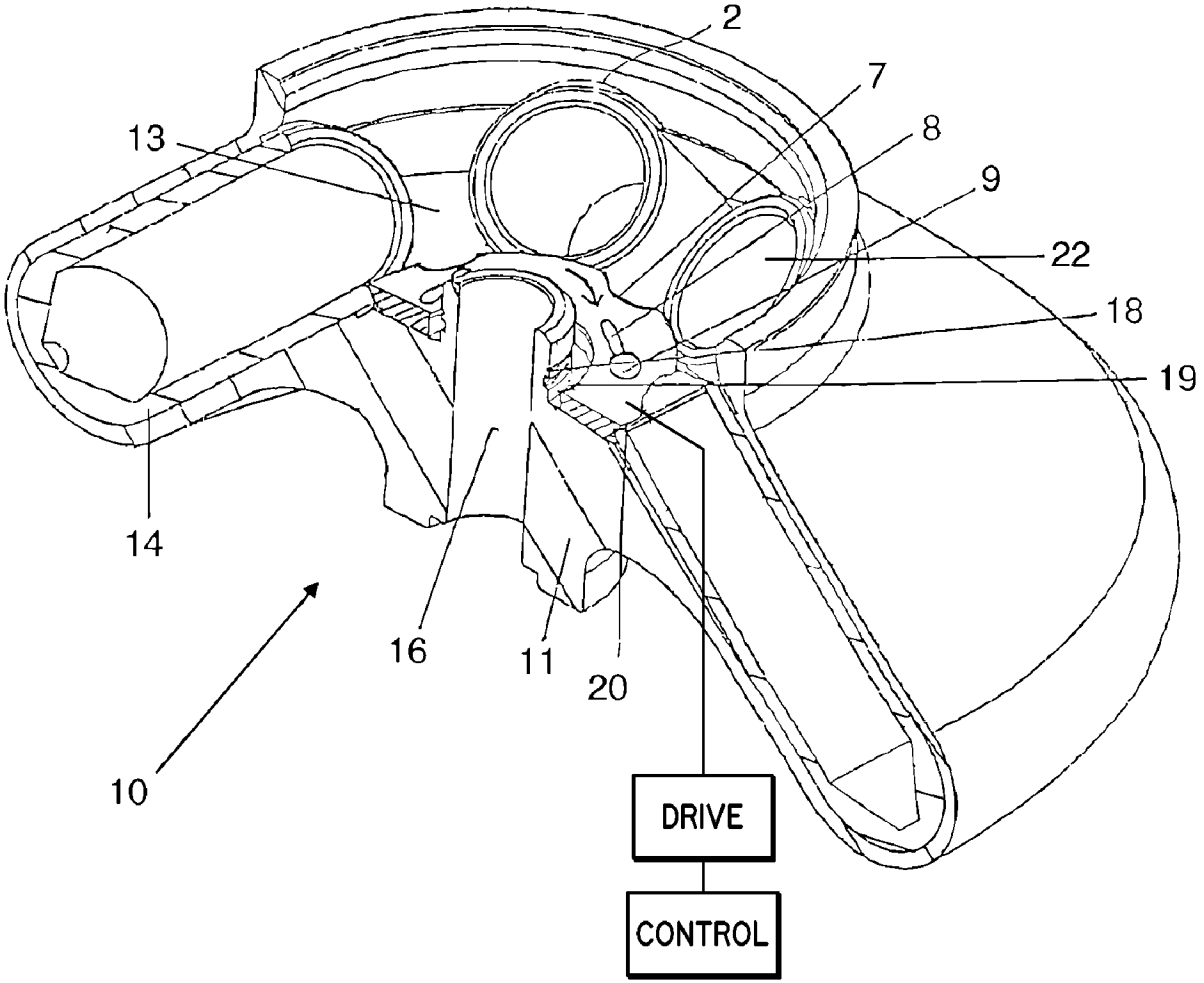
FIG. 2 shows a sectional, perspective side view of the rotor from FIG. 1, without a rotor cap.

FIG. 2 shows a sectional, perspective side view of a rotor 10 similar to that from FIG. 1, but without the cap and cap fastening screw. The annular disk 20, designed as a rotary lock, contacts the inner edges of the adapter 14 which are inclined toward the rotor axis, and holds all adapters 14 in the rotor 10. Oblong holes 8 are also provided in the annular disk 20. Vertically protruding bolts 9 are provided in the bearing plate 19 which project through the oblong holes 8 and have a head on their upper ends. The diameter of the head is larger than the width of the oblong holes 8 so that the annular disk 20 cannot be removed from the bearing plate 19. Recesses 7 are also present in the outer edge of the annular disk 20. When the annular disk 20 is rotated in the direction of the arrow until it reaches the stop, the recesses 7 are respectively aligned with the inner edge of an adapter 14, thereby releasing the adapters and allowing them to be removed from the rotor 10.

Figure 3:
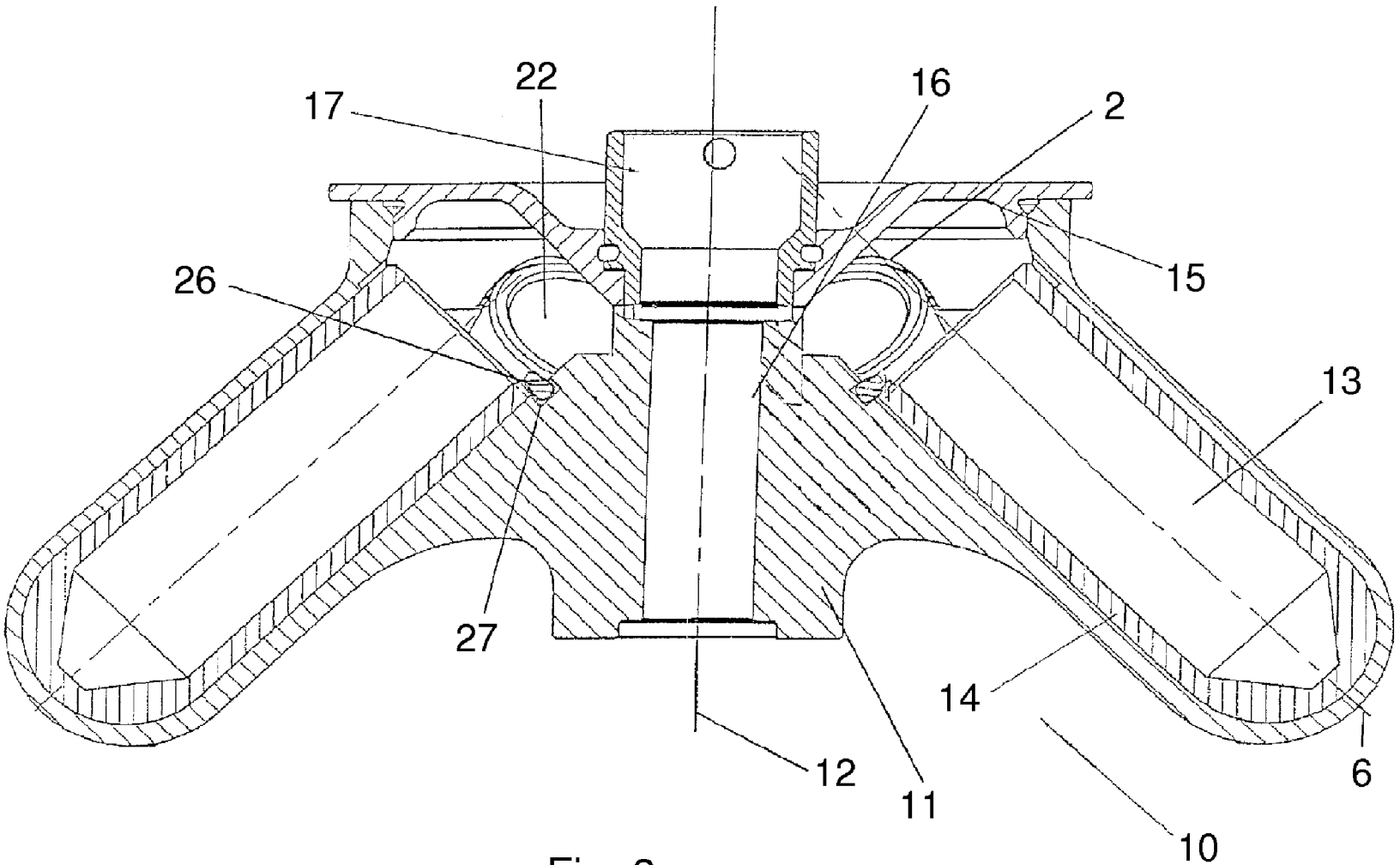
FIG. 3 shows a sectional side view of a rotor having a hold-down element designed as a rubber lip.

FIG. 3 shows a cross section of a rotor 10 for laboratory centrifuges, similar to the one from FIG. 1. In contrast to the rotor from FIG. 1, no sample vessel is provided in the left adapter 14 in the rotor 10. In addition, the hold-down element is designed as a circumferential rubber lip 26 situated concentrically about the rotor axis. The rubber lip 26 is guided in a groove 27 provided in the rotor body 11, in the upper region of the rotor hub 16. When the adapters 14 are inserted, the rubber lip 26 is compressed by the adapters 14 and pressed completely into the groove 27. As soon as the adapters 14 have been fully inserted into the annular trough 13, the rubber lip 26 returns to its original state. As a result of the rubber lip 26 being situated directly above the inner edge of the adapter 14, the rubber lip 26 provides resistance to the axial displacement of the inserted adapter 14. Increased application of force allows the rubber lip 26 to be pressed back into the groove 27 by pulling it out of the adapter 14, in order to remove the adapter 14 from the rotor 10 for cleaning purposes, for example.

Figure 4:
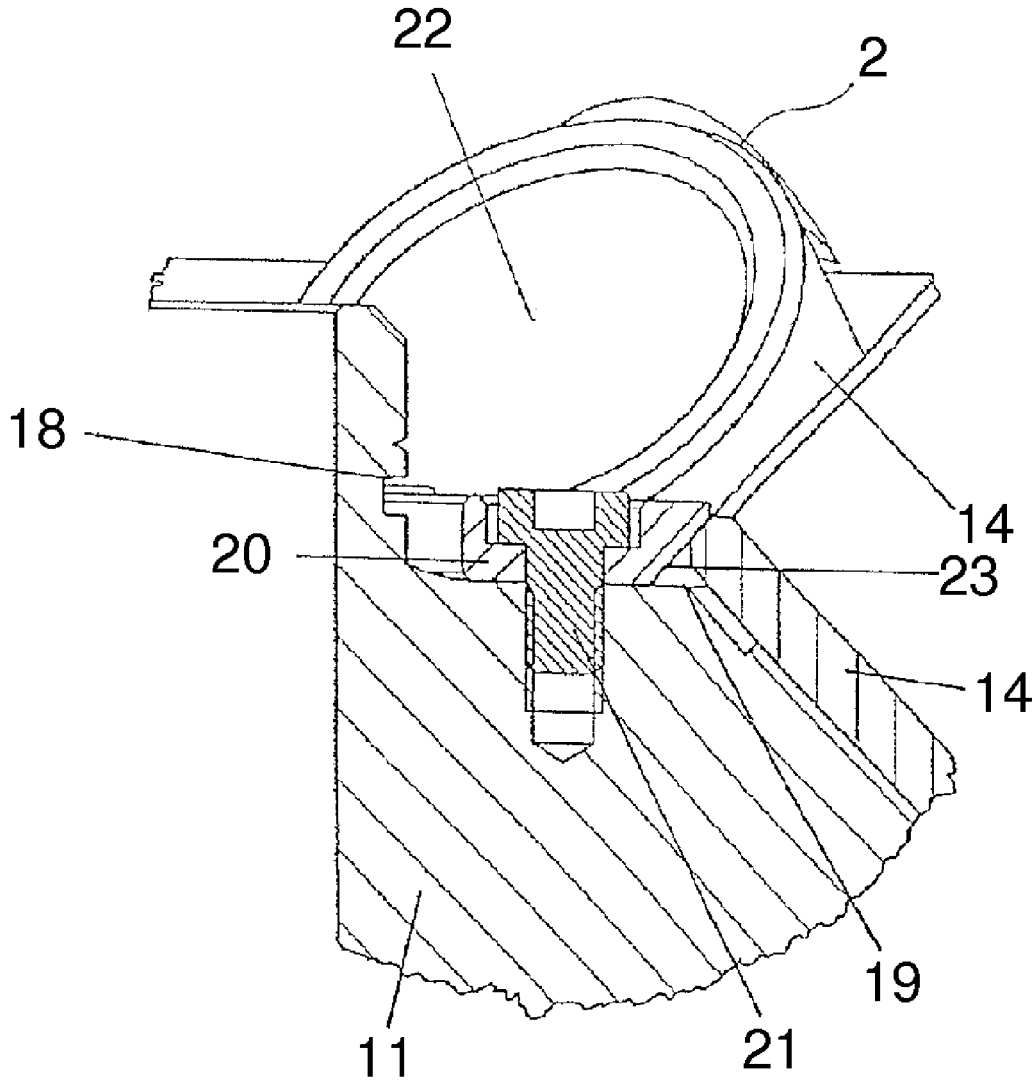
FIG. 4 shows a sectional side view of a partial region of the rotor from FIGS. 1 and 2.

FIG. 4 shows a partial cross section of the rotor from FIG. 1. It can be seen that the outer edge 23 of the annular disk 20 is beveled in such a way that the outer edge rests flush with the upper part of its face on the edge of the adapter 14, thereby forming the largest possible bearing surface.

Figure 5:
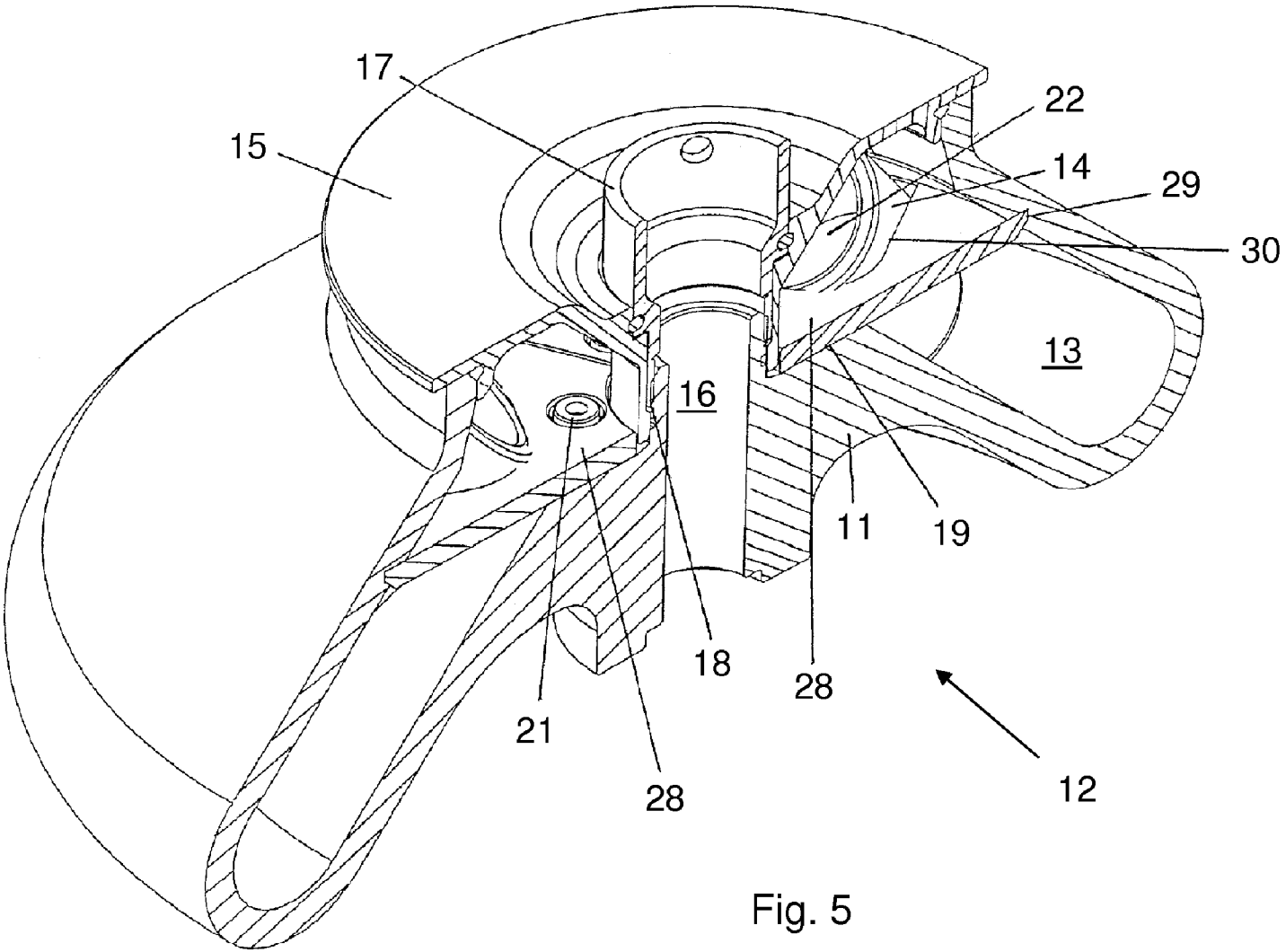
FIG. 5 shows a sectional, perspective side view of a rotor having multiple hold-down elements which brace the annular trough.

FIG. 5 shows a sectional, perspective side view of a rotor 10. Each of the adapters 14 situated in the annular trough 13 is held in the rotor 10 by a hold-down element designed as a circular segment 28. Each circular segment 28 rests on the bearing plate 19, in the region of the circular segment facing the rotor axis, and is fastened to the bearing plate by a screw 21. Each circular segment 28 has a recess 30 in its region projecting into the annular trough 13 through which a respective adapter 14 partially passes. The recesses 30 are designed so that the edge of the adapters 14 facing the rotor hub 16 contacts the circular segments 28 and is held by same in the rotor 10. In their edge regions the circular segments 28 run continuously in the radial direction, and with their end faces rest in a groove 29 provided inside the outer wall of the annular trough 13. Thus, the circular segments 28 perform a bracing function in addition to their hold-down function. The circular segments 28 therefore act as pressure supports, and more effectively prevent ovalization effects when the rotor 10 is under partial load. This bracing effect acts in addition to the spoke effect of the adapters 14 circumferentially situated in the annular trough. Therefore, in this embodiment sufficient rigidity may be achieved for reliable rotor operation, even when some of the adapters 14 are omitted during the centrifugation process. Because of this dual effect of the circular segments 28, a design would also be possible in which the circular segments perform only a bracing function but do not hold the adapters in the rotor. This may be practical if the adapters cannot be inserted until the end of the manufacturing process, and due to structural constraints the circular segments must be installed beforehand. In this embodiment, the rotor preferably has at least one additional hold-down element, particularly preferably rubber rings provided circumferentially around the adapters.

The groove 29 provided on the interior of the outer wall is used to better anchor the circular segments 28 in the rotor 10. The groove allows a positive-fit connection between the circular segment 28 and the rotor 10. Furthermore, the groove 29 may be designed as a toothed groove, or as locking elements which prevent displacement of the circular segments 28 in the circumferential direction.

Figure 6:
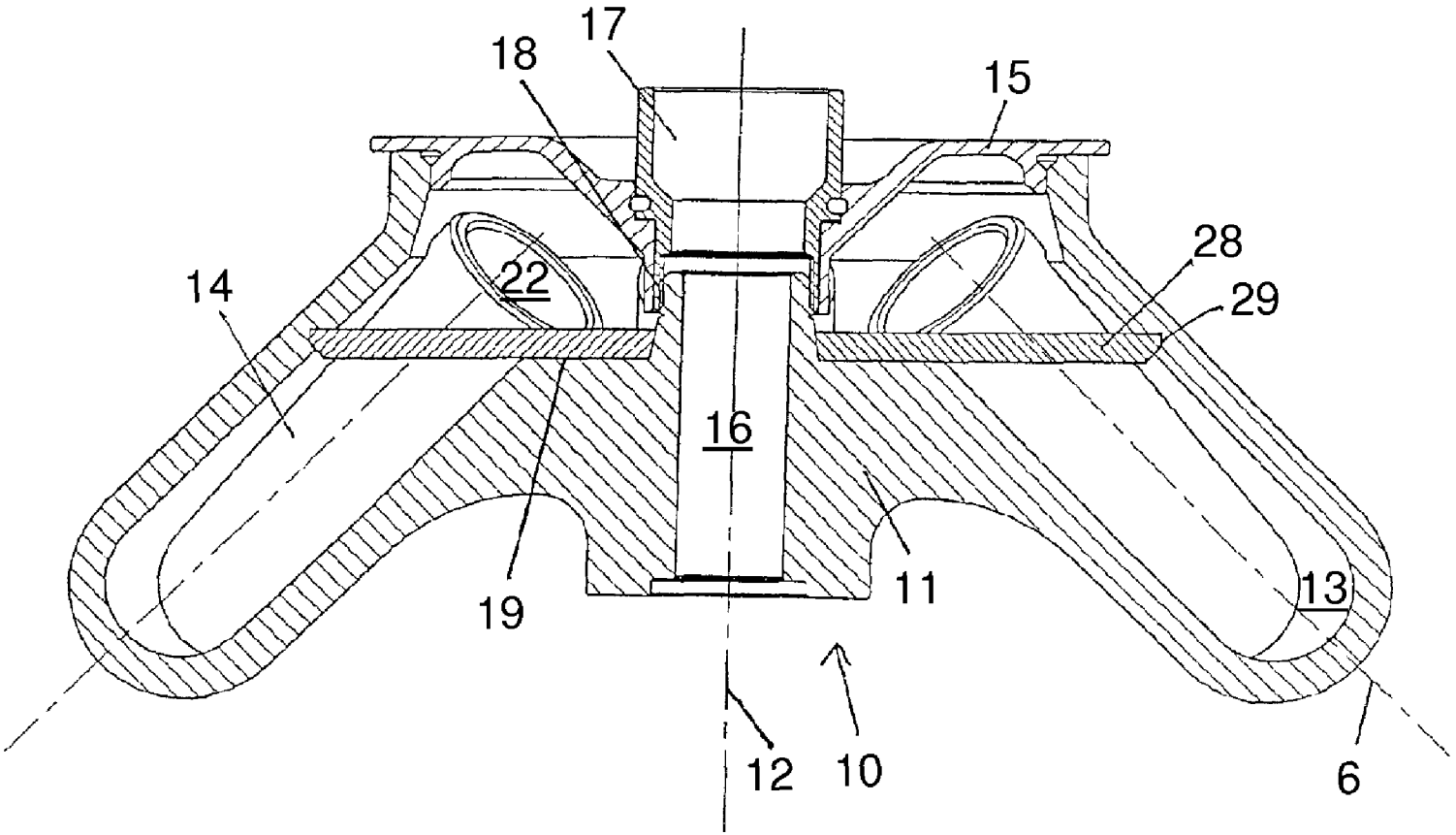
FIG. 6 shows a sectional side view of the rotor from FIG. 5, having hold-down elements with a pretensioning function.

FIG. 6 shows a sectional side view of the rotor from FIG. 5. In contrast to the illustration shown in FIG. 5, the circular segments 28 directly contact the rotor hub 16 with their inner edge, which is inclined toward the rotor axis 12. This contact region on the rotor hub 16 is upwardly tapered toward the rotor axis 12, thus forming a type of truncated cone. In this manner, pretensioning is applied to the outer wall of the annular trough 13 by bracing the circular segments 28 against the bearing plate 19, using the fastening screws (not illustrated here) or another suitable tightening device. The annular trough 13 is thereby spread outward, and the overall rigidity of the rotor is further improved.

Figure 7:
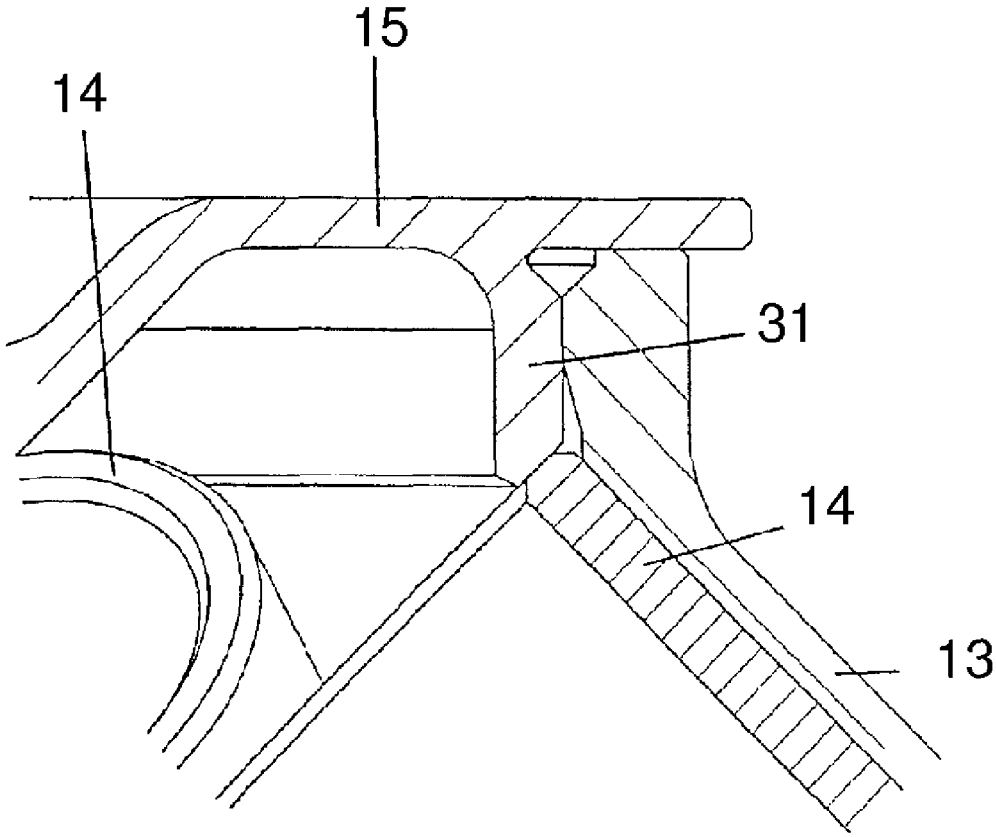
FIG. 7 shows a sectional side view of a partial region of a rotor having a hold-down element integrated into the cap.

FIG. 7 shows a sectional partial region of a rotor according to the invention. It can be seen that a circumferential ridge 31 is provided on the underside of the cap 15 which acts as a hold-down element. The ridge 31 projects essentially perpendicularly from the underside of the cap 15, and with its outer side contacts the interior of the outer wall of the annular trough 13. The end face of the ridge is beveled, so that it lies flat on the edge of an adapter 14 which is inclined toward the outer side of the rotor. The ridge 31, which is designed as a hold-down element, is thus designed to be integrated into the rotor cap 15. By bracing the rotor cap 15 against the rotor body, such as by screwing the rotor cap 15 into the rotor, tension is exerted on the adapter 14 by means of the ridge 31. The width of the ridge is matched to the wall thickness of the adapter 14 in such a way that a sample vessel (not illustrated here) placed in the adapter 14 is able to project beyond the upper edge of the adapter 14 and not be blocked by the ridge 31.

Figure 8:
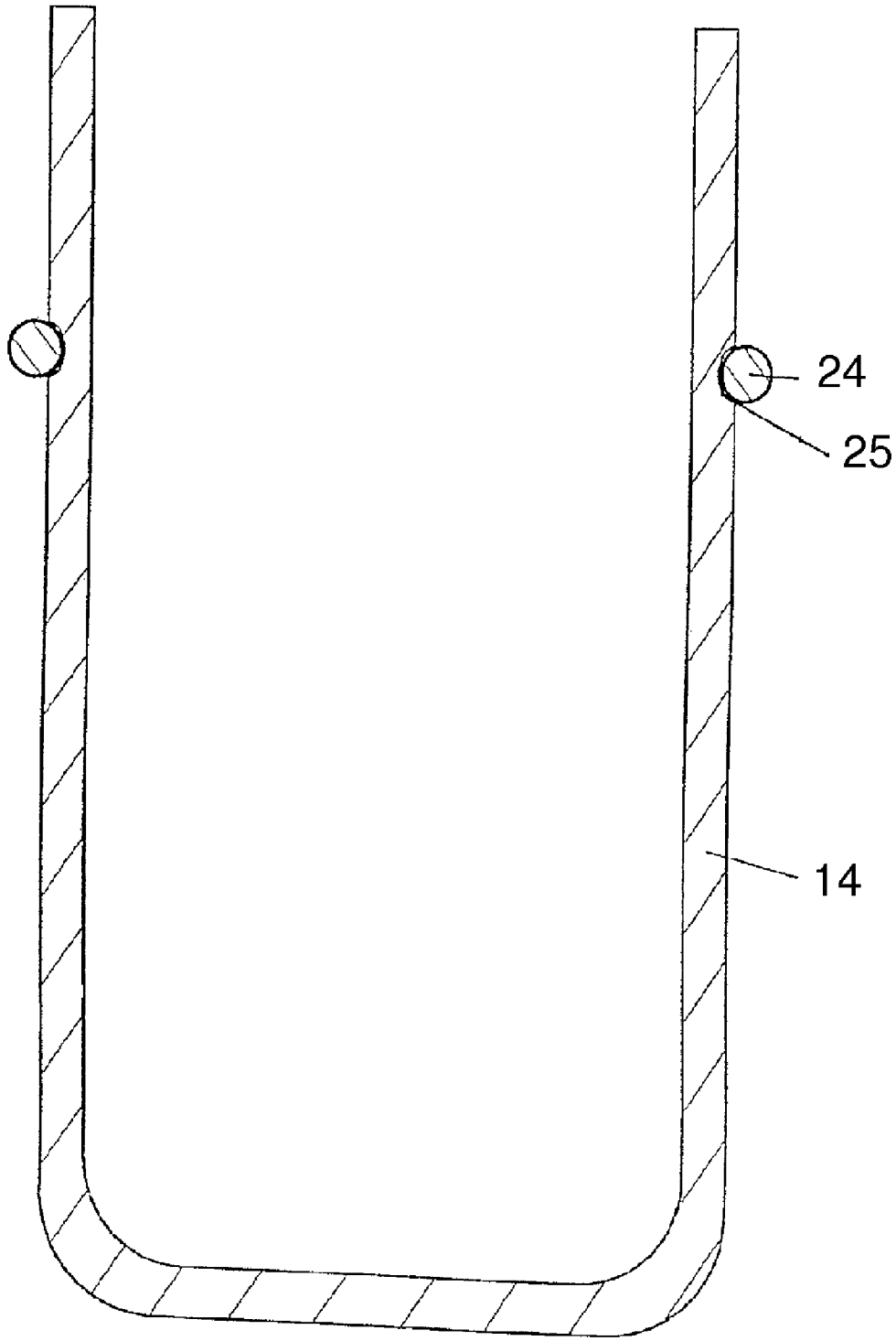
FIG. 8 shows an adapter having a hold-down element designed as a rubber ring.

FIG. 8 shows an adapter 14, on the outside of which rests a circumferential rubber ring 24 designed as a hold-down element. To ensure secure contact of the rubber ring 24 with the adapter 14, a circumferential groove 25 is provided in the outer wall of the adapter 14 in which the rubber ring 24 rests. The rubber ring 24 is thus sized so that the length of the overhang beyond the adapter 14 is larger than the play of the adapter 14 in the rotor (not illustrated here). The rubber ring 24 is thus compressed when the adapter 14 is inserted into the rotor, and a contact pressure is produced on the rotor. At the same time, the friction effect of the rubber ring 24 on the rotor body is increased, and the adapter 14 is thus protected from axial displacement.

The invention claimed is:

1. A rotor for laboratory centrifuges which is designed for accommodating at least one centrifugation container, comprising:

at least one hold-down element; and at least one retainable centrifugation container having a longitudinal axis, wherein the centrifugation container is prevented from displacement along the longitudinal axis when retained by the hold-down element, and wherein the hold-down element has a drive and is positionable in a holding position and a release position such that the hold-down element is configured to apply a force along the longitudinal axis of the at least one centrifugation container in the holding position.

2. A rotor according to claim 1, wherein the at least one hold-down element holds multiple centrifugation containers in the rotor.

3. A rotor according to claim 1, wherein the at least one hold-down element is placed in the holding position at least during a centrifugation process.

4. A rotor according to claim 1, wherein the at least one hold-down element, when placed in the holding position, is connected to the at least one centrifugation container with a positive fit.

5. A rotor according to claim 4, wherein the at least one hold-down element exerts a locking function on the centrifugation container.

6. A rotor according to claim 5, wherein parts of the at least one hold-down element are locking elements.

7. A rotor according to claim 6, wherein the locking element is a rotary or swivel lock.

8. A rotor according to claim 5, wherein the at least one hold-down element is a locking element.

9. A rotor according to claim 6, wherein the locking element is a sliding element.

10. A rotor according to claim 1, wherein the at least one hold-down element is self-locking.

11. A rotor according to claim 10, wherein the at least one hold-down element is positioned depending on an operating state.

12. A rotor according to claim 1, wherein the drive is selected from the group consisting of a pneumatic drive, a spring drive, and an electromotor drive.

13. A rotor according to claim 1, further comprising a control device to control the positioning of the at least one hold-down element.

14. A rotor according to claim 1, wherein the at least one hold-down element contacts an end face of the at least one centrifugation container.

15. Rotor according to claim 1, wherein the at least one hold-down element contacts a shoulder of the at least one centrifugation container.

16. A rotor according to claim 1, wherein the at least one hold-down element is an annular disk concentrically situated with respect to the rotor.

17. A rotor according to claim 16, wherein the annular disk contacts an inner edge region of the at least one centrifugation container.

18. A rotor according to claim 1, wherein the at least one hold-down element protects the at least one centrifugation container from displacement in a longitudinal direction of the rotor.

19. A rotor according to claim 1, wherein the at least one centrifugation container is conical.

20. A rotor according to claim 1, further comprising a circumferential annular trough to accommodate the at least one centrifugation container, wherein the at least one hold-down element is configure to brace the annular trough.

21. A rotor according to claim 1, wherein said at least one centrifugation container includes a plurality of centrifugation containers, circumferentially and evenly disposed around a rotor axis, that brace the rotor when retained by the hold-down element.

22. An adapter system for accommodating a sample vessel and for use in a laboratory centrifuge rotor, comprising at least one hold-down element to hold a retainable adapter having a longitudinal axis in the rotor and to prevent the adapter from displacement along the longitudinal axis when retained, wherein the hold-down element has a drive and is positionable in a holding position and a release position such that the hold-down element is configured to apply a force along the longitudinal axis of the adapter in the holding position.

23. An adapter system according to claim 22, wherein the at least one hold-down element is a locking element.

* * * * *

UNITED STATES PATENT AND TRADEMARK OFFICE

CERTIFICATE OF CORRECTION

PATENT NO. : 7,806,819 B2
APPLICATION NO. : 11/313627
DATED : October 5, 2010
INVENTOR(S) : Frank Eigemeier It is certified that error appears in the above-identified patent and that said Letters Patent is hereby corrected as shown below:

In column 9, line 19, change "with their end faces rest in a groove" to --with their end faces resting in a groove--.

In column 12, line 4, claim 20, change "at least one hold-down element is configure to brace" to --at least one hold-down element is configured to brace--.

Signed and Sealed this
First Day of February, 2011

David J. Kappos

David J. Kappos
*Director of the United States Patent and Trademark Office*